US010391602B2

(12) United States Patent
Akada et al.

(10) Patent No.: US 10,391,602 B2
(45) Date of Patent: Aug. 27, 2019

(54) METHOD FOR MULTIPLE CUTOFF MACHINING OF RARE EARTH MAGNET

(71) Applicant: Shin-Etsu Chemical Co., Ltd., Tokyo (JP)

(72) Inventors: Kazuhito Akada, Echizen (JP); Koji Sato, Echizen (JP); Naomichi Yoshimura, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 11 days.

(21) Appl. No.: 15/852,005

(22) Filed: Dec. 22, 2017

(65) Prior Publication Data

US 2018/0200860 A1 Jul. 19, 2018

Related U.S. Application Data

(63) Continuation of application No. 13/161,034, filed on Jun. 15, 2011, now abandoned.

(30) Foreign Application Priority Data

Jun. 16, 2010 (JP) ..... 2010-136822

(51) Int. Cl.

| | |
|---|---|
| ***B24B 27/06*** | (2006.01) |
| ***B24B 27/00*** | (2006.01) |
| ***B24D 5/12*** | (2006.01) |
| ***H01F 41/02*** | (2006.01) |
| *H01F 1/057* | (2006.01) |

(52) U.S. Cl.

CPC ..... *B24B 27/0675* (2013.01); *B24B 27/0076* (2013.01); *B24D 5/123* (2013.01); *H01F 41/0253* (2013.01); *H01F 1/0577* (2013.01)

(58) Field of Classification Search

CPC ..... B24B 27/0675; B24B 27/0076
USPC ..... 451/57, 58, 41, 28; 125/13.01
See application file for complete search history.

(56) References Cited

U.S. PATENT DOCUMENTS

| | | | |
|---|---|---|---|
| 6,293,270 | B1 | 9/2001 | Okazaki |
| 2004/0166654 | A1 | 8/2004 | Matsuda et al. |
| 2010/0112904 | A1 | 5/2010 | Sato et al. |

FOREIGN PATENT DOCUMENTS

| | | | |
|---|---|---|---|
| EP | 2189245 | A2 | 5/2010 |
| JP | H03-241856 | A | 10/1991 |
| JP | 5-92420 | A | 4/1993 |

(Continued)

OTHER PUBLICATIONS

European Search Report dated Oct. 10, 2011, issued in corresponding European Patent Application No. 11169881.7.

(Continued)

*Primary Examiner* — Robert A Rose
(74) *Attorney, Agent, or Firm* — Westerman, Hattori, Daniels & Adrian, LLP

(57) ABSTRACT

A rare earth magnet block is cutoff machined into pieces by rotating a plurality of cutoff abrasive blades. Improvements are made by starting the machining operation from the upper surface of the magnet block downward, interrupting the machining operation, turning the magnet block upside down, placing the magnet block such that the cutoff grooves formed before and after the upside-down turning may be aligned with each other, and restarting the machining operation from the upper surface of the upside-down magnet block downward until the cutoff grooves formed before and after the upside-down turning merge with each other.

19 Claims, 5 Drawing Sheets

(56) References Cited

FOREIGN PATENT DOCUMENTS

| | | | |
|---|---|---|---|
| JP | 07-171765 | A | 7/1995 |
| JP | 10-175172 | A | 6/1998 |
| JP | 2010-110850 | A | 5/2010 |
| JP | 2010-110851 | A | 5/2010 |
| JP | 2010-110966 | A | 5/2010 |

OTHER PUBLICATIONS

Japanese Office Action dated Sep. 10, 2013, issued in corresponding Japanese Patent Application No. 2010-136822 (3 pages).

METHOD FOR MULTIPLE CUTOFF MACHINING OF RARE EARTH MAGNET

CROSS-REFERENCE TO RELATED APPLICATION

This is a continuation application of U.S. application Ser. No. 13/161,034 filed on Jun. 15, 2011, which is a non-provisional application that claims priority under 35 U.S.C. § 119(a) on Patent Application No. 2010-136822 filed in Japan on Jun. 16, 2010, the entire contents of which are hereby incorporated by reference.

TECHNICAL FIELD

This invention relates to a method for cutoff machining a magnet block into multiple pieces.

BACKGROUND ART

Systems for manufacturing commercial products of rare earth magnet include a single part system wherein a part of substantially the same shape as the product is produced at the stage of press molding, and a multiple part system wherein once a large block is molded, it is divided into a plurality of parts by machining. These systems are schematically illustrated in FIGS. 1A and 1B. FIG. 1A illustrates the single part system including press molding, sintering or heat treating, and finishing steps. A molded part 101, a sintered or heat treated part 102, and a finished part (or product) 103 are substantially identical in shape and size. Insofar as normal sintering is performed, a sintered part of near net shape is obtained, and the load of the finishing step is relatively low. However, when it is desired to manufacture parts of small size or parts having a reduced thickness in magnetization direction, the sequence of press molding and sintering is difficult to form sintered parts of normal shape, leading to a lowering of manufacturing yield, and at worst, such parts cannot be formed.

In contrast, the multiple part system illustrated in FIG. 1B eliminates the above-mentioned problems and allows press molding and sintering or heat treating steps to be performed with high productivity and versatility. It now becomes the mainstream of rare earth magnet manufacture. In the multiple part system, a molded block 101 and a sintered or heat treated block 102 are substantially identical in shape and size, but the subsequent finishing step requires cutting. It is the key for manufacture of finished parts 103 how to cutoff machine the block in the most efficient and least wasteful manner.

Tools for cutting rare earth magnet blocks include two types, a diamond grinding wheel inner-diameter (ID) blade having diamond grits bonded to an inner periphery of a thin doughnut-shaped disk, and a diamond grinding wheel outer-diameter (OD) blade having diamond grits bonded to an outer periphery of a thin disk as a core. Nowadays the cutoff machining technology using OD blades becomes the mainstream, especially from the aspect of productivity. The machining technology using ID blades is low in productivity because of a single blade cutting mode. In the case of OD blade, multiple cutting is possible. FIG. 2 illustrates an exemplary multiple blade assembly 1 including a plurality of cutoff abrasive blades 11 coaxially mounted on a rotating shaft 12 alternately with spacers (not shown), each blade 11 including a core 11*b* in the form of a thin doughnut disk and an abrasive grain layer 11*a* on an outer peripheral rim of the core 11*b*. This multiple blade assembly 1 is capable of multiple cutoff machining, that is, to machine a block into a multiplicity of parts at a time.

For the manufacture of OD abrasive blades, diamond grains are generally bonded by three typical binding systems including resin bonding with resin binders, metal bonding with metal binders, and electroplating. These cutoff abrasive blades are often used in cutting off of rare earth magnet blocks.

When cutoff abrasive blades are used to machine a rare earth magnet block of certain size into a multiplicity of parts, the relationship of the cutting part (axial) width of the cutoff blade is crucially correlated to the material yield of the workpiece (magnet block). It is important to maximize a material yield and productivity by using a cutting part with a minimal thickness, machining at a high accuracy to minimize a machining allowance and reduce chips, and increasing the number of parts available.

In order to form a cutting part with a minimal width (or thinner cutting part) from the standpoint of material yield, the cutoff wheel core must be thin. In the case of OD blade 11 shown in FIG. 2, its core 11*b* is usually made of steel materials from the standpoints of material cost and mechanical strength. Of these steel materials, alloy tool steels classified as SK, SKS, SKD, SKT, and SKH according to the JIS standards are often used in commercial practice. However, in an attempt to cutoff machine a hard material such as rare earth magnet by a thin OD blade, the prior art core of alloy tool steel is short in mechanical strength and becomes deformed or bowed during cutoff machining, losing dimensional accuracy.

One solution to this problem is a cutoff wheel for use with rare earth magnet alloys including a core of cemented carbide to which high hardness abrasive grains such as diamond and cBN are bonded with a binding system such as resin bonding, metal bonding or electroplating, as described in JP-A 10-175172. Use of cemented carbide as the core material mitigates buckling deformation by stresses during machining, ensuring that rare earth magnet is cutoff machined at a high accuracy. However, if a short supply of cutting fluid is provided to the cutting part during machining of rare earth magnet, the cutoff wheel may give rise to problems like dulling and loading even when a core of cemented carbide is used, which problems increase the machining force during the process and induce chipping and bowing, providing a detrimental impact on the machined state.

Approaches to address this problem include arrangement of plural nozzles near the cutoff blades for forcedly feeding cutting fluid to the cutting parts and provision of a high capacity pump to feed a large volume of cutting fluid. The former approach is quite difficult to implement in combination with a multiple blade assembly including a plurality of blades arranged at a close spacing of about 1 mm because nozzles cannot be arranged near the blades. In the latter approach of feeding a large volume of cutting fluid, the air streams created around the cutting parts during rotation of the cutoff blades cause the cutting fluid to be divided and scattered away before it reaches the cutting parts. If a high pressure is applied to the cutting fluid to forcedly feed it, the pressure is detrimental to high-accuracy machining because it causes the cutoff blades to be bowed and generates vibration.

To solve these problems, improved methods for cutoff machining a rare earth magnet block have been proposed which methods can feed a small amount of cutting fluid to points of cutoff machining in an efficient manner and achieve cutoff machining at a high speed and a high accuracy as compared with the prior art.

One process of multiple cutoff machining a rare earth magnet block involves providing a multiple blade assembly including a plurality of cutoff abrasive blades mounted on a rotating shaft at axially spaced apart positions, and rotating the plurality of cutoff abrasive blades. A cutting fluid is effectively fed to the plurality of cutoff abrasive blades by providing a cutting fluid feed nozzle having a plurality of slits corresponding to the plurality of cutoff abrasive blades such that an outer peripheral portion of each cutoff abrasive blade may be inserted in the corresponding slit. Then the slits serve to restrict any axial run-out of the cutoff abrasive blades during rotation. At the same time, the cutting fluid reaching the slit and coming in contact with the outer peripheral portion of each cutoff abrasive blade is entrained on surfaces of the cutoff abrasive blade being rotated and transported toward the peripheral cutting part of the cutoff abrasive blade by the centrifugal force of rotation. As a result, the cutting fluid is effectively delivered to points of cutoff machining on the magnet block during multiple cutoff machining.

When cutoff grooves corresponding to the plurality of cutoff abrasive blades are formed in the surface of the magnet block, each cutoff groove serves to restrict any axial run-out during rotation of the cutoff abrasive blade whose outer peripheral portion is inserted in the cutoff groove. The cutting fluid flowing from each slit in the feed nozzle and across the surfaces of the cutoff abrasive blade flows into the cutoff groove and is then entrained on the surfaces of the cutoff abrasive blade being rotated whereby the cutting fluid is effectively fed to the blade cutting part during multiple cutoff machining.

Also a jig including a pair of jig segments for clamping the magnet block in the machining direction for securing the magnet block is proposed wherein the jig segments are provided on their surfaces with a plurality of guide grooves corresponding to the cutoff abrasive blades so that the outer peripheral portion of each cutoff abrasive blade may be inserted into the corresponding guide groove. Then the guide grooves serve to restrict any axial run-out of the cutoff abrasive blades during rotation. The cutting fluid flowing from each slit in the feed nozzle and across the surfaces of the cutoff abrasive blade flows in the guide groove and is then entrained on the surfaces of the cutoff abrasive blade being rotated whereby the cutting fluid is effectively fed to the blade cutting part during multiple cutoff machining.

In either case, cutoff machining of the magnet block can be performed at a high accuracy and a high speed while effectively feeding a smaller volume of cutting fluid than in the prior art to points of cutoff machining.

Nevertheless, the current desire for more efficient manufacture of rare earth sintered magnet entails a propensity to enlarge the size of magnet blocks to be cutoff machined, indicating an increased depth of cut. When a magnet block has an increased height, the effective diameter of the cutoff abrasive blade, that is, the distance from the rotating shaft or spacer to the outer periphery of the blade (corresponding to the maximum height of the cutoff abrasive blade available for cutting) must be increased. Such larger diameter cutoff abrasive blades are more liable to deformation, especially axial runout. As a result, a rare earth magnet block is cut into pieces of degraded shape and dimensional accuracy. The prior art uses thicker cutoff abrasive blades to avoid the deformation. Thicker cutoff abrasive blades, however, are inconvenient in that more material is removed by cutting. Then the number of magnet pieces cut out of a magnet block of the same size is reduced as compared with thin cutoff abrasive blades. Under the economy where the price of rare earth metals increases, a reduction in the number of magnet pieces is reflected by the manufacture cost of rare earth magnet products.

CITATION LIST

Patent Document 1: JP-A 10-175172
Patent Document 2: JP-A 07-171765
Patent Document 3: JP-A 05-92420
Patent Document 4: JP-A 2010-110850
Patent Document 5: JP-A 2010-110851
Patent Document 6: JP-A 2010-110966

DISCLOSURE OF INVENTION

An object of the invention is to provide a method for cutoff machining a rare earth magnet block having a substantial height into a multiplicity of pieces at a high accuracy, using a multiplicity of thin cutoff abrasive blades having a reduced effective diameter.

The invention is directed to a method for multiple cutoff machining a rare earth magnet block using a multiple blade assembly including a plurality of cutoff abrasive blades coaxially mounted on a rotating shaft at axially spaced apart positions, each said blade including a core in the form of a thin disk or thin doughnut disk and a peripheral cutting part on an outer peripheral rim of the core. The cutoff abrasive blades are rotated to cutoff machine the magnet block into a multiplicity of pieces. The inventor has found that the object is achievable by starting the machining operation from the upper surface of the magnet block downward, interrupting the machining operation before the magnet block is divided into pieces, turning the magnet block upside down, placing the magnet block such that the cutoff grooves formed before and after the upside-down turning may be vertically aligned with each other, and restarting the machining operation from the upper surface of the upside-down magnet block downward to form cutoff grooves in the magnet block until the cutoff grooves formed before and after the upside-down turning merge with each other, thereby cutting the magnet block into pieces. Only the addition of the simple step of turning the magnet block upside down ensures that a rare earth magnet block having a substantial height is cutoff machined into a multiplicity of pieces at a high accuracy and productivity, using a multiplicity of thin cutoff abrasive blades having a reduced effective diameter.

Accordingly the invention provides a method for multiple cutoff machining a rare earth magnet block using a multiple blade assembly including a plurality of cutoff abrasive blades coaxially mounted on a rotating shaft at axially spaced apart positions, each said blade including a core in the form of a thin disk or thin doughnut disk and a peripheral cutting part on an outer peripheral rim of the core, the method including the step of rotating the cutoff abrasive blades to cutoff machine the magnet block into pieces. The method further includes the steps of starting the machining operation from the upper surface of the magnet block downward to form cutoff grooves in the magnet block, interrupting the machining operation before the magnet block is cut into pieces, turning the magnet block upside down, placing the magnet block such that the cutoff grooves formed before and after the upside-down turning may be vertically aligned with each other, and restarting the machining operation from the upper surface of the upside-down magnet block downward to form cutoff grooves in the magnet block until the cutoff grooves formed before and after the upside-down turning merge with each other, thereby cutting the magnet block into pieces.

In a preferred embodiment, the side surface of the magnet block which is not subject to the machining operation is a reference plane, the magnet block is turned upside down and placed such that the reference planes may be aligned with each other before and after the upside-down turning whereby the cutoff grooves formed before and after the upside-down turning are vertically aligned with each other.

In a preferred embodiment, a jig for securing the magnet block in place is disposed such that a side surface of the jig is parallel to the cutting plane of the magnet block. The side surface is a reference plane. The jig together with the magnet block secured thereby is turned upside down and placed such that the reference planes may be aligned with each other before and after the upside-down turning whereby the magnet block is turned upside down and the cutoff grooves formed before and after the upside-down turning are vertically aligned with each other.

In a more preferred embodiment, the jig is designed to secure a plurality of magnet blocks, and the jig together with the plurality of magnet blocks secured thereby is turned upside down such that the cutoff grooves formed in the plurality of magnet blocks before and after the upside-down turning may be aligned with each other at the same time.

When a rare earth magnet block is cut into pieces by machining from both upper and lower directions, there is a likelihood that cutoff grooves extending in the magnet block from the upper side and cutoff grooves extending in the magnet block from the lower side are shifted or misaligned at the time when they merge with each other, leaving a step at the connection between upper and lower side cutoff grooves. In one embodiment, the side surface of the magnet block which is not subject to the machining operation is a reference plane, the magnet block is turned upside down such that the reference planes may be aligned with each other before and after the upside-down turning. In an alternative embodiment, a jig for securing the magnet block in place is disposed such that a side surface of the jig is parallel to the cutting plane of the magnet block, the side surface is a reference plane, and the jig is turned upside down such that the reference planes may be aligned with each other before and after the upside-down turning. In these embodiments, the step at the connection between upper and lower side cutoff grooves is minimized.

When a rare earth magnet block is cut into pieces by machining from both upper and lower directions, the effective diameter of the cutoff abrasive blades can be reduced to less than the height of the rare earth magnet block, and even to about half of the height of the rare earth magnet block. Then the space that must be defined around the magnet block for allowing the cutoff abrasive blades to move may be reduced. Then the size of the cutoff machining system may be reduced. In a further embodiment wherein the jig is designed to secure the magnet block by clamping at the opposite sides of the magnet block surface subject to machining, the length of slits which are formed in the jig to allow for entry of the cutoff abrasive blades may be reduced. From this aspect, the jig and hence the cutoff machining system can be reduced in size.

ADVANTAGEOUS EFFECT OF INVENTION

Using a multiplicity of thin cutoff abrasive blades having a reduced effective diameter, a rare earth magnet block having a substantial height can be cut into a multiplicity of pieces at a high accuracy. The invention is of great worth in the industry.

DESCRIPTION OF EMBODIMENTS

Figure 1A:
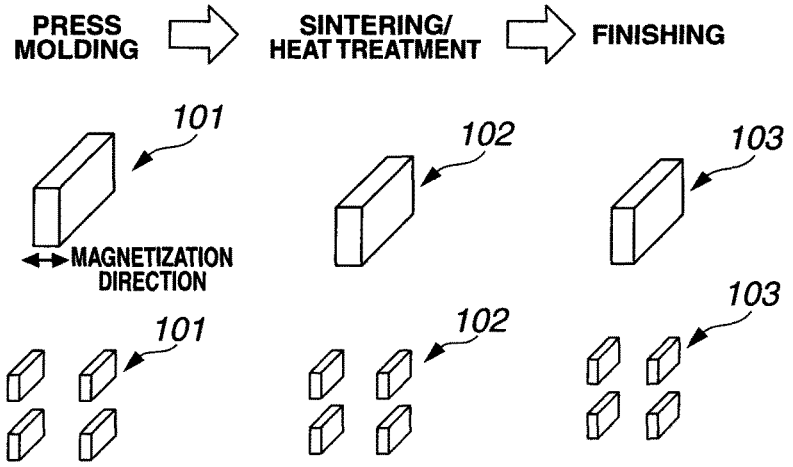
FIGS. 1A and 1B schematically illustrate rare earth magnet part manufacturing processes including press molding, sintering/heat treating and finishing steps, showing how the shape of parts changes in the successive steps.
Figure 1B:
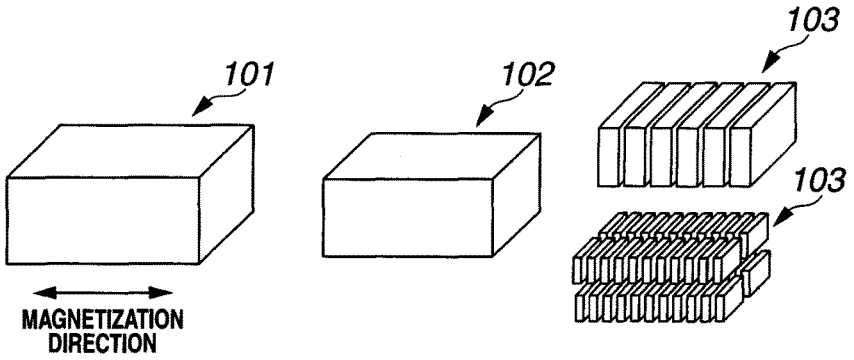

In the following description, like reference characters designate like or corresponding parts throughout the several views shown in the figures. It is also understood that terms such as "upper", "lower", "outward", "inward", "vertical", and the like are words of convenience, and are not to be construed as limiting terms. Herein, a magnet block has upper and lower surfaces and the magnet block which is turned upside down is also described as having upper and lower surfaces although the upper surface of the original magnet block becomes the lower surface of the upside-down turned magnet block. Also, the term "vertical" refers to a direction between upper and lower sides and need not be construed in a strict sense.

The method for multiple cutoff machining a rare earth magnet block according to the invention uses a multiple blade assembly including a plurality of cutoff abrasive blades coaxially mounted on a rotating shaft at axially spaced apart positions, each blade including a core in the form of a thin disk or thin doughnut disk and a peripheral cutting part on an outer peripheral rim of the core. The multiple blade assembly is placed relative to the magnet block. The cutoff abrasive blades are rotated to cutoff machine the magnet block into a multiplicity of magnet pieces. During machining, cutoff grooves are formed in the magnet block.

Figure 2:
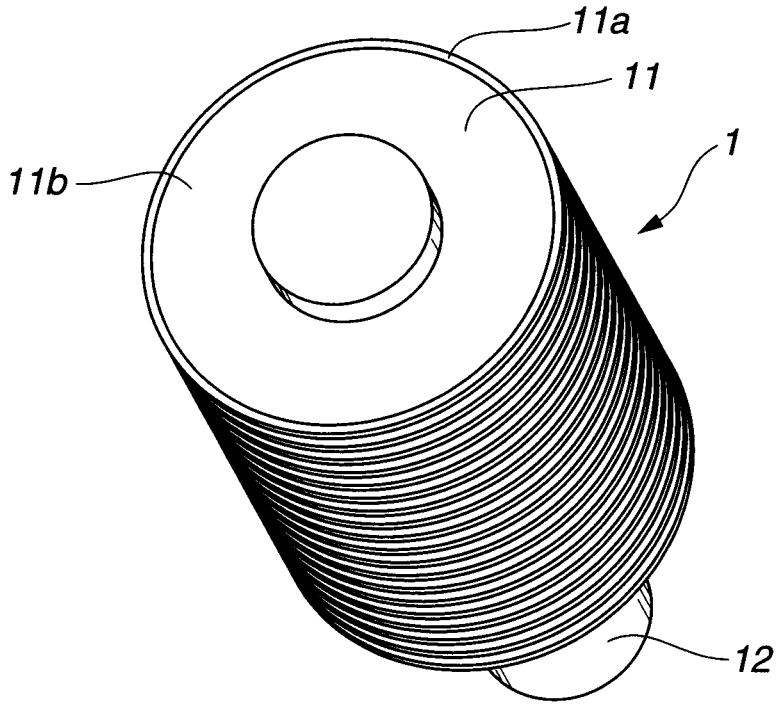
FIG. 2 is a perspective view illustrating one exemplary multiple blade assembly used in the invention.

Any prior art well-known multiple blade assembly may be used in the multiple cutoff machining method. As shown in FIG. 2, one exemplary multiple blade assembly 1 includes a rotating shaft 12 and a plurality of cutoff abrasive blades or OD blades 11 coaxially mounted on the shaft 12 alternately with spacers (depicted at 13 in FIGS. 3A and 3B), i.e., at axially spaced apart positions. Each blade 11 includes a core 11*b* in the form of a thin disk or thin doughnut disk and a peripheral cutting part or abrasive grain-bonded section 11*a* on an outer peripheral rim of the core 11*b*. Note that the number of cutoff abrasive blades 11 is not particularly limited, although the number of blades generally ranges from 2 to 100, with 19 blades illustrated in the example of FIG. 2.

The dimensions of the core are not particularly limited. Preferably the core has an outer diameter of 80 to 250 mm, more preferably 100 to 200 mm, and a thickness of 0.1 to 1.4 mm, more preferably 0.2 to 1.0 mm. The core in the form of a thin doughnut disk has a bore having a diameter of preferably 30 to 80 mm, more preferably 40 to 70 mm.

The core of the cutoff abrasive blade may be made of any desired materials commonly used in cutoff blades including steels SK, SKS, SKD, SKT and SKH, although cores of cemented carbide are preferred because the cutting part or blade tip can be thinner. Suitable cemented carbides of which cores are made include alloy forms of powdered carbides of metals in Groups IVB, VE and VIE in the Periodic Table, such as WC, TiC, MoC, NbC, TaC, and $Cr_3C_2$, which are cemented with Fe, Co, Ni, Mo, Cu, Pb, Sn or alloys thereof. Of these, WC—Co, WC—Ni, TiC—Co, and WC—TiC—TaC—Co systems are typical and preferred for use herein.

The peripheral cutting part or abrasive grain-bonded section is formed to cover the outer peripheral rim of the core and consists essentially of abrasive grains and a binder. Typically diamond grains, cBN grains or mixed grains of diamond and cBN are bonded to the outer peripheral rim of the core using a binder. Three binding systems including resin bonding with resin binders, metal bonding with metal binders, and electroplating are typical and any of them may be used herein.

The peripheral cutting part or abrasive grain-bonded section has a width W in the thickness or axial direction of the core, which is from (T+0.01) mm to (T+4) mm, more preferably (T+0.02) mm to (T+1) mm, provided that the core has a thickness T. An outer portion of the peripheral cutting part or abrasive grain-bonded section that projects radially outward from the outer peripheral rim of the core has a projection distance which is preferably 0.1 to 8 mm, more preferably 0.3 to 5 mm, depending on the size of abrasive grains to be bonded. An inner portion of the peripheral cutting part or abrasive grain-bonded section that radially extends on the core has a coverage distance which is preferably 0.1 to 10 mm, more preferably 0.3 to 8 mm.

The spacing between cutoff abrasive blades may be suitably selected depending on the thickness of magnet pieces after cutting, and preferably set to a distance which is slightly greater than the thickness of magnet pieces, for example, by 0.01 to 0.4 mm.

For machining operation, the cutoff abrasive blades are preferably rotated at 1,000 to 15,000 rpm, more preferably 3,000 to 10,000 rpm.

A rare earth magnet block is held as presenting upper and lower surfaces. The magnet block is machined and cut into a multiplicity of pieces by rotating the cutoff abrasive blades. According to the invention, the machining operation is started from the side of the upper surface of the magnet block downward to form cutoff grooves in the magnet block. The machining operation is interrupted once before the magnet block is divided into discrete pieces. At this point, the magnet block is turned upside down. The machining operation is restarted from the side of the upper surface of the upside-down magnet block downward to form cutoff grooves in the magnet block until the cutoff grooves formed before and after the upside-down turning merge with each other, thereby cutting the magnet block into pieces. Namely, the magnet block is machined in sequence from one surface side and then from the other surface side.

The cutoff machining method ensures that even though a multiplicity of thin cutoff abrasive blades having a reduced effective diameter are used, a rare earth magnet block having a substantial height can be cut into a multiplicity of pieces at a high accuracy.

The invention deals with a rare earth magnet block having a height of at least 5 mm, typically 10 to 100 mm and uses cutoff abrasive blades having a core thickness of up to 1.2 mm, more preferably 0.2 to 0.9 mm and an effective diameter of up to 200 mm, more preferably 80 to 180 mm. Notably, the effective diameter is the distance from the rotating shaft or spacer to the outer edge of the blade and corresponds to the maximum height of a magnet block that can be cut by the blade. Then the magnet block can be cutoff machined at a high accuracy and high efficiency as compared with the prior art.

Once the magnet block is turned upside down, it is placed such that the upper and lower cutoff grooves before and after upside-down turning (specifically, upper grooves which will be machined and lower grooves which have been machined at this point of time) are vertically in alignment.

Alignment before and after upside-down turning may be conducted in mode (1) wherein the side surface of the magnet block which is not subject to cutoff machining is used as a reference plane, and the magnet block is turned upside down and placed such that the reference planes may be aligned with each other before and after the upside-down turning; or in mode (2) wherein the magnet block is secured by a jig such that the side surface of the jig is parallel to the cutting plane of the magnet block, the side surface is used as a reference plane, and the jig with the magnet block held therein is turned upside down and placed such that the reference planes may be aligned with each other before and after the upside-down turning. As long as alignment is conducted by either of these modes, the magnet block can be cut into a multiplicity of pieces without leaving any step in the connection between cutoff grooves before and after the upside-down turning.

Particularly in mode (2), if a plurality of magnet blocks are secured by the jig and the jig is turned upside down, then the cutoff grooves formed in the plurality of magnet blocks are simultaneously aligned with each other before and after the upside-down turning.

A rare earth magnet block is cutoff machined into a multiplicity of pieces by rotating cutoff abrasive blades (i.e., OD blades), feeding cutting fluid, and moving the blades relative to the magnet block with the abrasive portion of the blade kept in contact with the magnet block (specifically moving the blades in the transverse and/or thickness direction of the magnet block). Then the magnet block is cut or machined by the cutoff abrasive blades.

In multiple cutoff machining of a magnet block, the magnet block is fixedly secured by any suitable means. In one method, the magnet block is bonded to a support plate (e.g., of carbon base material) with wax or a similar adhesive which can be removed after machining operation, whereby the magnet block is fixedly secured prior to machining operation. In another method, a jig is used for clamping the magnet block for fixedly securing it.

In machining of a magnet block, first either one or both of the multiple blade assembly and the magnet block are relatively moved in the cutting or transverse direction of the magnet block from one end to the other end of the magnet block, whereby the upper surface of the magnet block is machined to a predetermined depth throughout the transverse direction to form cutoff grooves in the magnet block.

The cutoff grooves may be formed by a single machining operation or by repeating plural times machining operation in the height direction of the magnet block. The depth of the cutoff grooves is preferably 40 to 60%, most preferably about 50% of the height of the magnet block to be cut. The width of the cutoff grooves is determined by the width of cutoff abrasive blades. Usually, the width of the cutoff grooves is slightly greater than the width of the cutoff abrasive blades due to the vibration of the cutoff abrasive blades during machining operation, and specifically in the range from more than the width of the cutoff abrasive blades (or peripheral cutting part) to 1 mm, and more preferably up to 0.5 mm.

The machining operation is interrupted once before the magnet block is divided into discrete pieces. The magnet block is turned upside down. The machining operation is restarted from the side of the upper (originally lower) surface of the upside-down magnet block downward. Like prior to the upside-down turning, either one or both of the multiple blade assembly and the magnet block are relatively moved in the cutting or transverse direction of the magnet block from one end to the other end of the magnet block, whereby the upper surface of the magnet block is machined to a predetermined depth throughout the transverse direction to form cutoff grooves in the magnet block. Likewise, the cutoff grooves may be formed by a single machining operation or by repeating plural times machining operation in the height direction of the magnet block. In this way, the portion of the magnet block left after the first groove cutting is cut off.

During the machining operation, the cutoff abrasive blades are preferably rotated at a circumferential speed of at least 10 m/sec, more preferably 20 to 80 m/sec. Also, the cutoff abrasive blades are preferably fed at a feed or travel rate of at least 10 mm/min, more preferably 20 to 500 mm/min. Advantageously, the inventive method capable of high speed machining ensures a higher accuracy and higher efficiency during machining than the prior art methods.

During multiple cutoff machining of a rare earth magnet block, a cutting fluid is generally fed to the cutoff abrasive blades to facilitate machining. To this end, a cutting fluid feed nozzle is preferably used which has a cutting fluid inlet at one end and a plurality of slits formed at another end and corresponding to the plurality of cutoff abrasive blades such that an outer peripheral portion of each cutoff abrasive blade may be inserted in the corresponding slit.

Figure 3A:
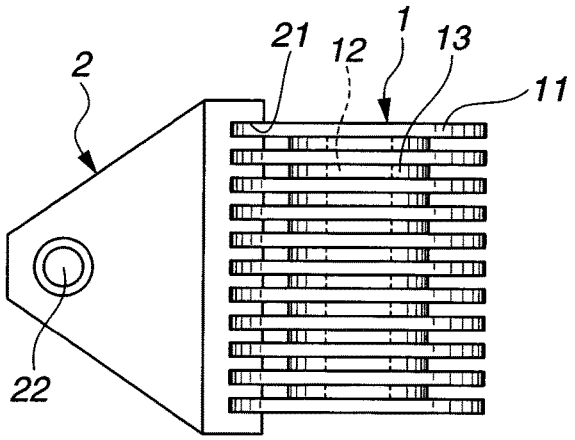
FIGS. 3A-3C illustrate one exemplary multiple blade assembly combined with a cutting fluid feed nozzle, FIG. 3A being a plan view, FIG. 3B being a side elevational view, and FIG. 3C being a front view of the nozzle showing slits.
Figure 3B:
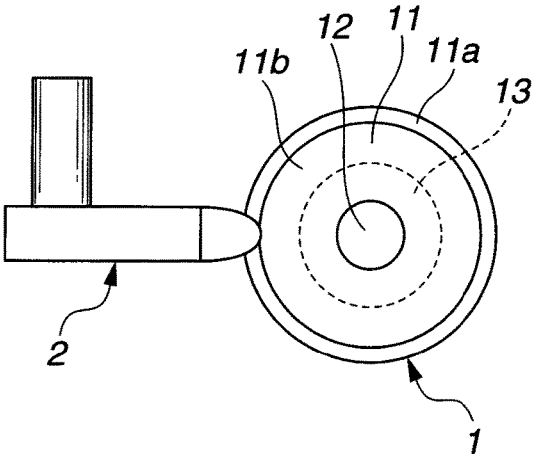
Figure 3C:
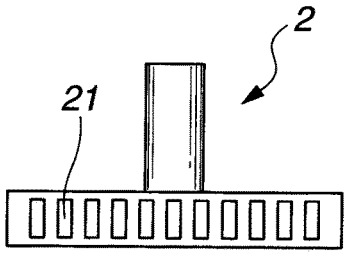

One exemplary cutting fluid feed nozzle is illustrated in FIGS. 3A-3C. This cutting fluid feed nozzle 2 includes a hollow housing which has an opening at one end serving as a cutting fluid inlet 22 and is provided at the other end with a plurality of slits 21. The number of slits corresponds to the number of cutoff abrasive blades and is typically equal to the number of cutoff abrasive blades 11 in the multiple blade assembly 1. The number of slits is not particularly limited although the number of slits generally ranges from 2 to 100, with eleven slits illustrated in the example of FIGS. 3A-3C. The feed nozzle 2 is combined with the multiple blade assembly 1 such that an outer peripheral portion of each cutoff abrasive blade 11 may be inserted into the corresponding slit 21 in the feed nozzle 2. Then the slits 21 are arranged at a spacing which corresponds to the spacing between cutoff abrasive blades 11, and the slits 21 extend straight and parallel to each other. It is seen from FIGS. 3A-3C that spacers 13 are disposed on the rotating shaft 12 between the cutoff abrasive blades 11.

The outer peripheral portion of each cutoff abrasive blade which is inserted into the corresponding slit in the feed nozzle functions such that the cutting fluid coming in contact with the cutoff abrasive blades is entrained on the surfaces (outer peripheral portions) of the cutoff abrasive blades and transported to points of cutoff machining on the magnet block. Then the slit has a width which must be greater than the width of the cutoff abrasive blade (i.e., the width W of the outer cutting part). Through slits having too large a width, the cutting fluid may not be effectively fed to the cutoff abrasive blades and a more fraction of cutting fluid may drain away from the slits. Provided that the peripheral cutting part of the cutoff abrasive blade has a width W (mm), the slit in the feed nozzle preferably has a width of from more than W mm to (W+6) mm, more preferably from (W+0.1) mm to (W+6) mm.

The slit has such a length that when the outer peripheral portion of the cutoff abrasive blade is inserted into the slit, the outer peripheral portion may come in full contact with the cutting fluid within the feed nozzle. Often, the slit length is preferably about 2% to 30% of the outer diameter of the core of the cutoff abrasive blade.

In the method for multiple cutoff machining a rare earth magnet block, a magnet block securing jig consisting of a pair of jig segments is preferably used for clamping the magnet block in the machining direction for fixedly securing the magnet block. One or both of the jig segments are provided on their surfaces with a plurality of guide grooves corresponding to the cutoff abrasive blades so that the outer peripheral portion of each cutoff abrasive blade may be inserted into the corresponding guide groove.

Figure 4A:
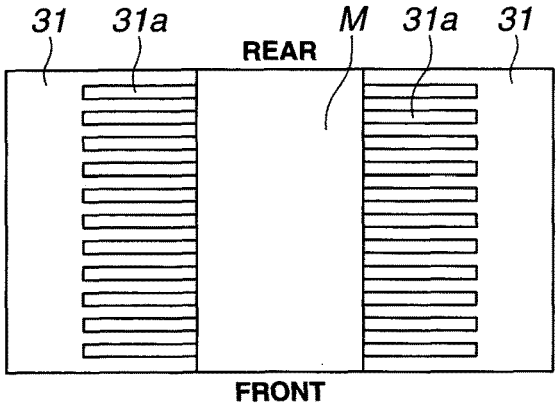
FIGS. 4A-4C illustrate one exemplary magnet block securing jig, FIG. 4A being a plan view, FIG. 4B being a side view, and FIG. 4C being a front view of the jig segment showing guide grooves.
Figure 4B:
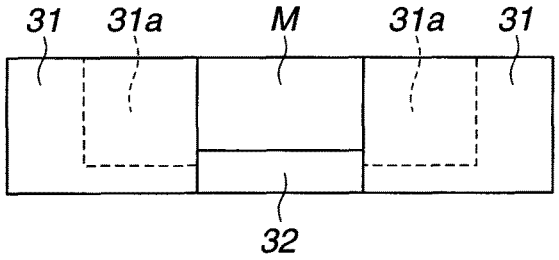
Figure 4C:
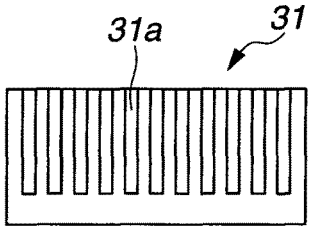

FIGS. 4A-4C show one exemplary magnet block securing jig. The jig includes a support plate 32 on which a magnet block M is rested and a pair of block pressing segments 31, 31 disposed on opposite sides of the plate 32. The pair of jig segments 31, 31 are adapted to press the magnet block M in the machining direction (transverse direction) for fixedly securing the magnet block M to the support plate 32 while they are retained utilizing screws, clamps, pneumatic or hydraulic cylinders, or wax (not shown). The jig segments 31, 31 are provided on their surfaces with a plurality of guide grooves 31*a* corresponding to cutoff abrasive blades 11 of multiple blade assembly 1. Note that the number of guide grooves 31*a* is not particularly limited, although eleven grooves are illustrated in the example of FIGS. 4A-4C.

Figure 5A:
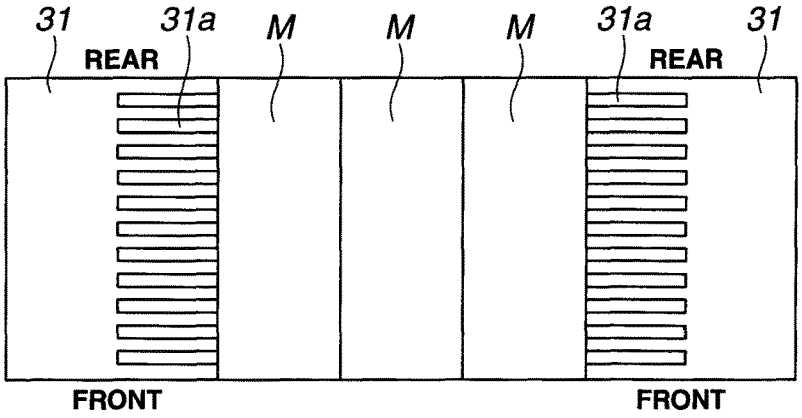
FIGS. 5A and 5B illustrate another exemplary magnet block securing jig, FIG. 5A being a plan view, and FIG. 5B being a side view.
Figure 5B:
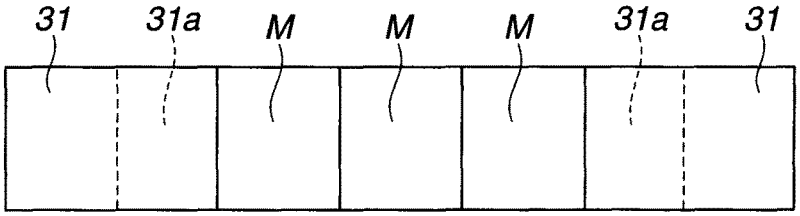

FIGS. 5A and 5B show another exemplary magnet block securing jig. The jig includes a pair of block pressing segments 31, 31 disposed on opposite sides of three magnet blocks M in parallel arrangement. The pair of jig segments 31, 31 are adapted to press the magnet blocks M in the machining direction (transverse direction) for fixedly securing the magnet block M to the support plate 32 while they are retained utilizing screws, clamps, pneumatic or hydraulic cylinders, or wax (not shown). Although three magnet blocks M are shown in FIGS. 5A and 5B, the number of magnet blocks is not limited thereto. The jig segments 31, 31 are provided on their surfaces adjacent to the magnet block with a plurality of guide grooves 31*a* corresponding to cutoff abrasive blades 11 of multiple blade assembly 1. Note that the number of guide grooves 31*a* is not particularly limited, although eleven grooves are illustrated in the example of FIGS. 5A and 5B. In the embodiment of FIGS. 5A-5B, the guide grooves 31*a* vertically penetrate throughout the segment 31. The jig of this construction has the advantage that the jig with the magnet blocks secured therein may be turned upside down without a need to remove the magnet blocks from the jig, and machining operation may be soon restarted on the magnet blocks in the jig.

During machining operation, an outer peripheral portion of each cutoff abrasive blade 11 is inserted into the corresponding guide groove 31*a* in the jig segment 31. Then the grooves 31*a* are arranged at a spacing which corresponds to the spacing between cutoff abrasive blades 11, and the grooves 31*a* extend straight and parallel to each other. The spacing between guide grooves 31*a* is equal to or less than the thickness of magnet pieces cut from the magnet block M. The width of each guide groove should be greater than the width of each cutoff abrasive blade (i.e., the width of the peripheral cutting part). Provided that the peripheral cutting part of the cutoff abrasive blade has a width W (mm) the guide groove should preferably have a width of more than W mm to (W+6) mm and more preferably from (W+0.1) mm to (W+6) mm. The length (in cutting direction) and height of each guide groove are selected such that the cutoff abrasive blade may be moved within the guide groove during machining of the magnet block.

The workpiece which is intended herein to cutoff machine is a rare earth magnet block. The rare earth magnet as the workpiece is not particularly limited. Suitable rare earth magnets include sintered rare earth magnets of R—Fe—B systems wherein R is at least one rare earth element inclusive of yttrium.

Suitable sintered rare earth magnets of R—Fe—B systems are those magnets containing, in weight percent, 5 to 40% of R, 50 to 90% of Fe, and 0.2 to 8% of B, and optionally one or more additive elements selected from C, Al, Si, Ti, V, Cr, Mn, Co, Ni, Cu, Zn, Ga, Zr, Nb, Mo, Ag, Sn, Hf, Ta, and W, for the purpose of improving magnetic properties and corrosion resistance. The amounts of additive elements added are conventional, for example, up to 30 wt % of Co, and up to 8 wt % of the other elements. The additive elements, if added in extra amounts, rather adversely affect magnetic properties.

Suitable sintered rare earth magnets of R—Fe—B systems may be prepared, for example, by weighing source metal materials, melting, casting into an alloy ingot, finely dividing the alloy into particles with an average particle size of 1 to 20 μm, i.e., sintered R—Fe—B magnet powder, compacting the powder in a magnetic field, sintering the compact at 1,000 to 1,200° C. for 0.5 to 5 hours, and heat treating at 400 to 1,000° C.

EXAMPLE

Examples and Comparative Examples are given below for further illustrating the invention although the invention is not limited thereto.

Example 1

OD blades (cutoff abrasive blades) were fabricated by providing a doughnut-shaped disk core of cemented carbide (consisting of WC 90 wt %/Co 10 wt %) having an outer diameter 120 mm, inner diameter 40 mm, and thickness 0.3 mm, and bonding, by the resin bonding technique, artificial diamond abrasive grains to an outer peripheral rim of the core to form an abrasive section (peripheral cutting part) containing 25% by volume of diamond grains with an average particle size of 150 Km. The axial extension of the abrasive section from the core was 0.05 mm on each side, that is, the abrasive portion had a width of 0.4 mm (in the thickness direction of the core).

Using the OD blades, a cutting test was carried out on a workpiece which was a sintered Nd—Fe—B magnet block. The test conditions are as follows. A multiple blade assembly was manufactured by coaxially mounting 41 OD blades on a shaft at an axial spacing of 2.1 mm, with spacers interposed therebetween. The spacers each had an outer diameter 95 mm inner diameter 40 mm, and thickness 2.1 mm. The multiple blade assembly was designed so that the magnet block was cut into magnet strips having a thickness of 2.0 mm.

The multiple blade assembly consisting of 41 OD blades and 40 spacers alternately mounted on the shaft was combined with a cutting fluid feed nozzle as shown in FIGS. 3A-3C, such that the outer peripheral portion of each OD blade was inserted into the corresponding slit in the feed nozzle. Specifically an outer portion of the OD blade radially extending 8 mm from the blade tip was inserted into the slit. The slit portion of the feed nozzle had a wall thickness of 2.5 mm, and the slits had a width of 0.6 mm. The OD blade extended in alignment with the slit.

The workpiece was a sintered Nd—Fe—B magnet block having a length 100 mm, width 30 mm and height 17 mm, which was polished on all six surfaces at an accuracy of ±0.05 mm by a vertical double-disk polishing tool. By the multiple blade assembly, the magnet block was transversely machined and longitudinally divided into a multiplicity of magnet strips of 2.0 mm thick. Specifically, one magnet block was cut into 40 magnet strips.

The sintered Nd—Fe—B magnet block was secured at opposite sides in the cutting direction by a jig (shown in FIGS. 4A-4C) including a pair of segments in which guide grooves having a length of 30 mm (in the transverse direction of the block), a width of 0.9 mm (in the longitudinal direction of the block), and a height of 19 mm were defined in the same number (=41) as the OD blades and at positions corresponding to the OD blades such that the cutting positions were aligned with the guide grooves. In securing the block, alignment was performed using the side surface of the magnet block appearing on the front side in FIG. 4A as the reference. In this example, the upper surface of the jig (on the side of the multiple blade assembly) was flush with the upper surface of the magnet block (on the side of the multiple blade assembly) as workpiece.

For machining operation, a cutting fluid was fed at a flow rate of 30 L/min. First, the multiple blade assembly was placed above one jig segment by which the magnet block was secured, and moved downward toward the magnet block so that the OD blades were inserted 1 mm from their tip into the guide grooves. While feeding cutting fluid from the feed nozzle and rotating the OD blades at 7,000 rpm (circumferential speed of 44 m/sec), the multiple blade assembly was fed at a rate of 100 mm/min from the one to the other jig segment for machining the magnet block in its transverse direction. At the end of this stroke, the assembly was fed back to the one jig segment side without changing its height. In this way, cutoff grooves of 1 mm deep were formed in the magnet block.

Next, above the one jig segment, the multiple blade assembly was moved 1 mm downward toward the magnet block. While feeding cutting fluid from the feed nozzle and rotating the OD blades at 7,000 rpm, the multiple blade assembly was fed at a rate of 100 mm/min from the one to the other jig segment for machining the magnet block in its transverse direction. At the end of this stroke, the assembly was fed back to the one jig segment side without changing its height. This machining operation was repeated 9 times in total. In this way, cutoff grooves of 9 mm deep from the upper surface were formed in the magnet block.

Thereafter, the magnet block was once released from the jig. The magnet block was turned upside down such that the side surface of the magnet block appearing on the front side in FIG. 4A might appear on the front side again after the upside-down turning. Alignment was conducted using the side surface of the magnet block appearing on the front side in FIG. 4A as the reference, and the magnet block was secured in place again by the jig.

Next, like the machining operation before the upside-down turning, the multiple blade assembly above one jig segment was moved downward toward the magnet block so that the OD blades were inserted 1 mm from their tip into the guide grooves. While feeding cutting fluid from the feed nozzle and rotating the OD blades at 7,000 rpm, the multiple blade assembly was fed at a rate of 100 mm/min from the one to the other jig segment for machining the magnet block in its transverse direction. At the end of this stroke, the assembly was fed back to the one jig segment side without changing its height. In this way, cutoff grooves of 1 mm deep were formed in the magnet block.

Next, above the one jig segment, the multiple blade assembly was moved 1 mm downward toward the magnet block. While feeding cutting fluid from the feed nozzle and rotating the OD blades at 7,000 rpm, the multiple blade assembly was fed at a rate of 100 mm/min from the one to the other jig segment for machining the magnet block in its transverse direction. At the end of this stroke, the assembly was fed back to the one jig segment side without changing its height. This machining operation was repeated 9 times in total. In this way, cutoff grooves were formed in the magnet block to a depth of 9 mm from the upper surface whereupon the cutoff grooves merged with each other, that is, the magnet block was cut into discrete strips.

After magnet strips were cut using the OD blades constructed as above, they were measured for thickness between the machined surfaces at the center by a micrometer. The strips were rated "passed" if the measured thickness was within a cut size tolerance of 2.0±0.05 mm. If the measured thickness was outside the tolerance, the multiple blade assembly was tailored by adjusting the thickness of spacers, so that the measured thickness might fall within the tolerance. If the spacer adjustment was repeated more than two times for the same OD blades, these OD blades were judged as having lost stability and replaced by new OD blades. Under these conditions, 1,000 magnet blocks were cutoff machined. The evaluation results of the machined state are shown in Table 1.

Comparative Example 1

A magnet block was cutoff machined by the same procedure as in Example 1 except that the spacers used in the multiple blade assembly each had an outer diameter 80 mm, inner diameter 40 mm, and thickness 2.1 mm, and the magnet block was machined throughout its overall height by repeating the 1-mm machining operation 18 times in total without turning the magnet block upside down at a mid stage. In this way, 1,000 magnet blocks were cutoff machined, and the machined state was evaluated. The evaluation results are also shown in Table 1.

TABLE 1

| | | After machining | | | | | | | | | |
|---|---|---|---|---|---|---|---|---|---|---|---|
| | Number | 200 blocks | | 400 blocks | | 600 blocks | | 800 blocks | | 1,000 blocks | |
| | of strips | A | B | A | B | A | B | A | B | A | B |
| Example 1 | 40 | 0 | 0 | 0 | 0 | 0 | 0 | 0 | 0 | 0 | 0 |
| Comparative Example 1 | 40 | 18 | 3 | 31 | 10 | 51 | 14 | 68 | 24 | 105 | 34 |

A: number of spacer adjustments
B: number of OD blade replacements

As seen from Table 1, the multiple cutoff machining method of the invention maintains consistent dimensional accuracy for products over a long term despite the reduced blade thickness and is successful in reducing the number of spacer adjustments and the number of OD blade replacements. Then an increase in productivity is attained.

Example 2

OD blades (cutoff abrasive blades) were fabricated by providing a doughnut-shaped disk core of cemented carbide (consisting of WC 90 wt %/Co 10 wt %) having an outer diameter 115 mm, inner diameter 40 mm, and thickness 0.35 mm, and bonding, by the resin bonding technique, artificial diamond abrasive grains to an outer peripheral rim of the core to form an abrasive section (peripheral cutting part) containing 25% by volume of diamond grains with an average particle size of 150 μm. The axial extension of the abrasive section from the core was 0.025 mm on each side, that is, the abrasive portion had a width of 0.4 mm (in the thickness direction of the core).

Using the OD blades, a cutting test was carried out on a workpiece which was a sintered Nd—Fe—B magnet block. The test conditions are as follows. A multiple blade assembly was manufactured by coaxially mounting 42 OD blades on a shaft at an axial spacing of 2.1 mm, with spacers interposed therebetween. The spacers each had an outer diameter 90 mm, inner diameter 40 mm and thickness 2.1 mm. The multiple blade assembly was designed so that the magnet block was cut into magnet strips having a thickness of 2.0 mm.

The multiple blade assembly consisting of 42 OD blades and 41 spacers alternately mounted on the shaft was combined with a cutting fluid feed nozzle as shown in FIGS. 3A-3C, such that the outer peripheral portion of each OD blade was inserted into the corresponding slit in the feed nozzle. Specifically an outer portion of the OD blade radially extending 8 mm from the blade tip was inserted into the slit. The slit portion of the feed nozzle had a wall thickness of 2.5 mm, and the slits had a width of 0.6 mm. The OD blade extended in alignment with the slit.

The workpiece was a sintered Nd—Fe—B magnet block having a length 99 mm, width 30 mm and height 17 mm, which was polished on all six surfaces at an accuracy of ±0.05 mm by a vertical double-disk polishing tool. By the multiple blade assembly, the magnet block was transversely machined and longitudinally divided into a multiplicity of magnet strips of 2.0 mm thick. Specifically, one magnet block was cut into 41 magnet strips.

Three sintered Nd—Fe—B magnet blocks were arranged in a transverse direction. The magnet block arrangement was secured at opposite sides in the cutting direction (=transverse direction) by a jig (shown in FIGS. 5A and 5B) including a pair of segments in which guide grooves having a length of 70 mm (in the transverse direction of the block), a width of 0.9 mm (in the longitudinal direction of the block), and a height of 17 mm were defined in the same number (=42) as the OD blades and at positions corresponding to the OD blades such that the cutting positions were aligned with the guide grooves. The jig segments had dimensions of 100 mm, 100 mm, and 17 mm in the longitudinal, transverse and height directions of the magnet block, respectively. The guide grooves were formed in the segment adjacent to the magnet block and extended vertically throughout the segment. In securing the magnet blocks, alignment was performed using the side surface of the magnet blocks appearing on the rear side in FIG. 5A as the reference. In this example, the upper surface of the jig (on the side of the multiple blade assembly) was flush with the upper surface of the magnet blocks (on the side of the multiple blade assembly) as workpiece, and the opposite sides of the magnet blocks in the longitudinal direction are positioned 0.5 mm inward of the opposite sides of the jig segments.

For machining operation, a cutting fluid was fed at a flow rate of 30 L/min. First, the multiple blade assembly was placed above one jig segment by which the magnet blocks were secured, and moved downward toward the magnet block so that the OD blades were inserted 9 mm from their tip into the guide grooves. While feeding cutting fluid from the feed nozzle and rotating the OD blades at 7,000 rpm (circumferential speed of 42 m/sec), the multiple blade assembly was fed at a rate of 20 mm/min from the one to the other jig segment for machining the magnet blocks in their transverse direction. At the end of this stroke, the assembly was fed back to the one jig segment side without changing its height. In this way, cutoff grooves of 9 mm deep were formed in the magnet blocks.

Thereafter, the jig was turned upside down such that the side surface of the jig appearing on the front side in FIG. 5A might appear on the front side again after the upside-down turning. Alignment was conducted using the side surface of the magnet block appearing on the rear side in FIG. 5A as the reference, and the jig was secured for holding the magnet blocks in place again.

Next, like the machining operation before the upside-down turning, the multiple blade assembly above one jig segment was moved downward toward the magnet block so that the OD blades were inserted 9 mm from their tip into the guide grooves. While feeding cutting fluid from the feed nozzle and rotating the OD blades at 7,000 rpm, the multiple blade assembly was fed at a rate of 20 mm/min from the one to the other jig segment for machining the magnet blocks in their transverse direction. At the end of this stroke, the assembly was fed back to the one jig segment side without changing its height. In this way, cutoff grooves were formed in the magnet blocks to a depth of 9 mm from their upper surface whereupon the cutoff grooves merged with each other, that is, the magnet block was cut into discrete strips.

After magnet strips were cut using the OD blades constructed as above, they were measured for thickness between the machined surfaces at the center by a micrometer. The strips were rated "passed" if the measured thickness was within a cut size tolerance of 2.0±0.05 mm. If the measured thickness was outside the tolerance, the multiple blade assembly was tailored by adjusting the thickness of spacers, so that the measured thickness might fall within the tolerance. If the spacer adjustment was repeated more than two times for the same OD blades, these OD blades were judged as having lost stability and replaced by new OD blades. Under these conditions, 1,000 magnet blocks were cutoff machined. The evaluation results of the machined state are shown in Table 2.

TABLE 2

| | | After machining | | | | | | | | | |
|---|---|---|---|---|---|---|---|---|---|---|---|
| | Number | 200 blocks | | 400 blocks | | 600 blocks | | 800 blocks | | 1,000 blocks | |
| | of strips | A | B | A | B | A | B | A | B | A | B |
| Example 2 | 41 | 0 | 0 | 0 | 0 | 0 | 0 | 0 | 0 | 0 | 0 |

A: number of spacer adjustments
B: number of OD blade replacements

As seen from Table 2, the multiple cutoff machining method of the invention maintains consistent dimensional accuracy for products over a long term despite the thin abrasive blade based on cemented carbide core and is successful in reducing the number of spacer adjustments and the number of OD blade replacements. Then increases in productivity and the number of cutoff strips are attained.

Example 3

OD blades (cutoff abrasive blades) were fabricated by providing a doughnut-shaped disk core of cemented carbide (consisting of WC 90 wt %/Co 10 wt %) having an outer diameter 145 mm, inner diameter 40 mm, and thickness 0.5 mm, and bonding, by the resin bonding technique, artificial diamond abrasive grains to an outer peripheral rim of the core to form an abrasive section (peripheral cutting part) containing 25% by volume of diamond grains with an average particle size of 150 μm. The axial extension of the abrasive section from the core was 0.05 mm on each side, that is, the abrasive portion had a width of 0.6 mm. (in the thickness direction of the core).

Using the OD blades, a cutting test was carried out on a workpiece which was a sintered Nd—Fe—B magnet block. The test conditions are as follows. A multiple blade assembly was manufactured by coaxially mounting 14 OD blades on a shaft at an axial spacing of 3.1 mm, with spacers interposed therebetween. The spacers each had an outer diameter 100 mm, inner diameter 40 mm, and thickness 3.1 mm. The multiple blade assembly was designed so that the magnet block was cut into magnet strips having a thickness of 3.0 mm.

The multiple blade assembly consisting of 14 OD blades and 13 spacers alternately mounted on the shaft was combined with a cutting fluid feed nozzle as shown in FIGS. 3A-3C, such that the outer peripheral portion of each OD blade was inserted into the corresponding slit in the feed nozzle. Specifically an outer portion of the OD blade radially extending 8 mm from the blade tip was inserted into the slit. The slit portion of the feed nozzle had a wall thickness of 2.5 mm, and the slits had a width of 0.8 mm. The OD blade extended in alignment with the slit.

The workpiece was a sintered Nd—Fe—B magnet block having a length 47 mm, width 70 mm and height 40 mm, which was polished on all six surfaces at an accuracy of ±0.05 mm by a vertical double-disk polishing tool. By the multiple blade assembly, the magnet block was transversely machined and longitudinally divided into a multiplicity of magnet strips of 3.0 mm thick. Specifically, one magnet block was cut into 13 magnet strips.

The sintered Nd—Fe—B magnet block was secured at opposite sides in the cutting direction by a jig (shown in FIGS. 4A-4C) including a pair of segments in which guide grooves having a length of 100 mm, a width of 0.8 mm, and a height of 42 mm (in the width, length and height directions of the block, respectively) were defined in the same number (=14) as the OD blades and at positions corresponding to the OD blades such that the cutting positions were aligned with the guide grooves. In securing the block, alignment was performed using the side surface of the magnet block appearing on the front side in FIG. 4A as the reference. In this example, the upper surface of the jig (on the side of the multiple blade assembly) was flush with the upper surface of the magnet block (on the side of the multiple blade assembly) as workpiece.

For machining operation, a cutting fluid was fed at a flow rate of 30 L/min. First, the multiple blade assembly was placed above one jig segment by which the magnet block was secured, and moved downward toward the magnet block so that the OD blades were inserted 1 mm from their tip into the guide grooves. While feeding cutting fluid from the feed nozzle and rotating the OD blades at 9,000 rpm (circumferential speed of 59 m/sec), the multiple blade assembly was fed at a rate of 150 mm/min from the one to the other jig segment for machining the magnet block in its transverse direction. At the end of this stroke, the assembly was fed back to the one jig segment side without changing its height. In this way, cutoff grooves of 1 mm deep were formed in the magnet block.

Next, above the one jig segment, the multiple blade assembly was moved 1 mm downward toward the magnet block. While feeding cutting fluid from the feed nozzle and rotating the OD blades at 9,000 rpm, the multiple blade assembly was fed at a rate of 150 mm/min from the one to the other jig segment for machining the magnet block in its transverse direction. At the end of this stroke, the assembly was fed back to the one jig segment side without changing its height. This machining operation was repeated 21 times in total. In this way, cutoff grooves of 21 mm deep from the upper surface were formed in the magnet block.

Thereafter, the magnet block was once released from the jig. The magnet block was turned upside down such that the side surface of the magnet block appearing on the front side in FIG. 4A might appear on the front side again after the upside-down turning. Alignment was conducted using the side surface of the magnet block appearing on the front side in FIG. 4A as the reference, and the magnet block was secured in place again.

Next, like the machining operation before the upside-down turning, the multiple blade assembly above one jig segment was moved downward toward the magnet block so that the OD blades were inserted 1 mm from their tip into the guide grooves. While feeding cutting fluid from the feed nozzle and rotating the OD blades at 9,000 rpm, the multiple blade assembly was fed at a rate of 150 mm/man from the one to the other jig segment for machining the magnet block in its transverse direction. At the end of this stroke, the assembly was fed back to the one jig segment side without changing its height. In this way, cutoff grooves of 1 mm deep were formed in the magnet block.

Next, above the one jig segment, the multiple blade assembly was moved 1 mm downward toward the magnet block. While feeding cutting fluid from the feed nozzle and rotating the OD blades at 9,000 rpm, the multiple blade assembly was fed at a rate of 150 mm/min from the one to the other jig segment for machining the magnet block in its transverse direction. At the end of this stroke, the assembly was fed back to the one jig segment side without changing its height. This machining operation was repeated 20 times in total. In this way, cutoff grooves were formed to a depth of 20 mm from the magnet block surface whereupon the cutoff grooves merged with each other, that is, the magnet block was cut into discrete strips.

Figure 6A:
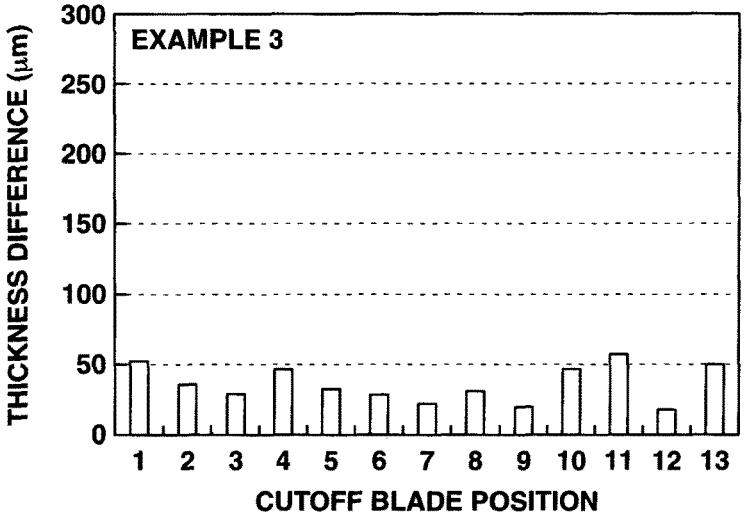
FIGS. 6A and 6B are graphs showing thickness variations of multiple magnet strips cut in Example 3 and Comparative Example 2, respectively, as measured at five points shown in FIG. 6C.
Figure 6B:
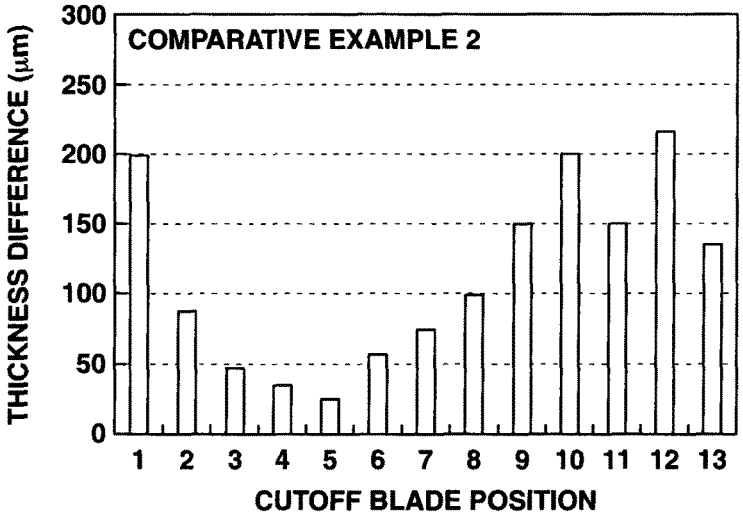
Figure 6C:
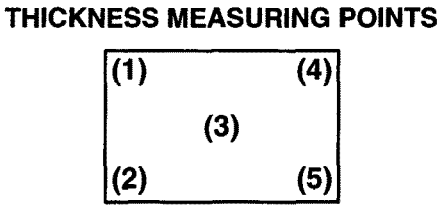

The magnet strips cut using the OD blades constructed as above were measured for thickness between the machined surfaces at five points (center and corners) as shown in FIG. 6C by a micrometer. A difference between maximum and minimum thicknesses was determined, with the results shown in the graph of FIG. 6C.

Comparative Example 2

A magnet block was cutoff machined by the same procedure as in Example 3 except that the spacers used in the multiple blade assembly each had an outer diameter 60 mm, inner diameter 40 mm, and thickness 3.1 mm, and the magnet block was machined throughout its overall height by repeating the 1-mm machining operation 41 times in total without turning the magnet block upside down at a mid stage. The results of thickness difference are shown in the graph of FIG. 6B.

The graphs of FIGS. 6A and 6B demonstrate that the multiple cutoff machining method of the invention achieves a significant improvement in the accuracy of cutoff machining.

Japanese Patent Application No. 2010-136822 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for multiple cutoff machining a rare earth magnet block, using a multiple blade assembly comprising a plurality of cutoff abrasive blades coaxially mounted on a rotating shaft at axially spaced apart positions, each said blade comprising a core in the form of a thin disk or thin doughnut disk and a peripheral cutting part on an outer peripheral rim of the core, said method comprising the step of rotating the cutoff abrasive blades to cutoff machine the magnet block into pieces, said method further comprising the steps of:

cutoff machining the magnet block with using the multiple blade assembly by first machining operation started from the upper surface of the magnet block downward to form cutoff grooves in the magnet block, interrupting the machining operation before the magnet block is cut into pieces, turning the magnet block upside down, placing the magnet block such that the cutoff grooves formed before and after the upside-down turning may be vertically aligned with each other, and cutoff machining the magnet block with using the multiple blade assembly by second machining operation restarted from the upper surface of the upside-down magnet block downward to form cutoff grooves in the magnet block until the cutoff grooves formed before and after the upside-down turning merge with each other, thereby cutting the magnet block into pieces, wherein in both of the first and second machining operations, respectively one multiple blade assembly is used.

2. The method of claim 1 wherein the side surface of the magnet block which is not subject to the machining operation is a reference plane, the magnet block is turned upside down and placed such that the reference planes may be aligned with each other before and after the upside-down turning whereby the cutoff grooves formed before and after the upside-down turning are vertically aligned with each other.

3. The method of claim 1 wherein a jig for securing the magnet block in place is disposed such that a side surface of the jig is parallel to the cutting plane of the magnet block, the side surface is a reference plane, the jig together with the magnet block secured thereby is turned upside down and placed such that the reference planes may be aligned with each other before and after the upside-down turning whereby the magnet block is turned upside down and the cutoff grooves formed before and after the upside-down turning are vertically aligned with each other.

4. The method of claim 3 wherein the jig is designed to secure a plurality of magnet blocks, and the jig together with the plurality of magnet blocks secured thereby is turned upside down such that the cutoff grooves formed in the plurality of magnet blocks before and after the upside-down turning may be aligned with each other at the same time.

5. The method of claim 1 wherein the rare earth magnet block is a sintered rare earth magnet block.

6. The method of claim 1 wherein said magnet block to be cut has a height of 5 to 100 mm, and in both of said machining operations from the upper surface of the magnet block and from the upper surface of the upside-down magnet block, said magnet block is machined by using the multiple blade assembly comprising the cores having an outer diameter of 80 to 250 mm, and having an effective diameter of up to 200 mm.

7. The method of claim 1 wherein in both of the first and second machining operations, the same multiple blade assembly is used.

8. The method of claim 1 wherein the multiple blade assembly used in restarting the second machining operation is the same multiple blade assembly used in starting the first machining operation.

9. The method of claim 1 wherein the outer periphery surface of the peripheral cutting part is formed to a shape of an outer periphery surface of a cylinder.

10. A method for multiple cutoff machining a rare earth magnet block, using a multiple blade assembly comprising a plurality of cutoff abrasive blades coaxially mounted on a rotating shaft at axially spaced apart positions, each said blade comprising a core in the form of a thin disk or thin doughnut disk and a peripheral cutting part on an outer peripheral rim of the core, said method comprising the step of rotating the cutoff abrasive blades to cutoff machine the magnet block into pieces, said method further comprising the steps of:

cutoff machining the magnet block with using the multiple blade assembly by first machining operation started from the upper surface of the magnet block downward to form cutoff grooves in the magnet block, until the depth of the cutoff grooves is reached to 40 to 60% of the height of magnet block to be cut having a height of 5 to 100 mm, interrupting the machining operation before the magnet block is cut into pieces, turning the magnet block upside down, placing the magnet block such that the cutoff grooves formed before and after the upside-down turning may be vertically aligned with each other, cutoff machining the magnet block with using the multiple blade assembly by second machining operation restarted from the upper surface of the upside-down magnet block downward to form cutoff grooves corresponding to the remainder of the height of magnet block to be cut in the magnet block until the cutoff grooves formed before and after the upside-down turning merge with each other, and interrupting the second machining operation at the point of merging the cutoff grooves, thereby cutting the magnet block into pieces.

11. The method of claim 10 wherein the side surface of the magnet block which is not subject to the machining operation is a reference plane, the magnet block is turned upside down and placed such that the reference planes may be aligned with each other before and after the upside-down turning whereby the cutoff grooves formed before and after the upside-down turning are vertically aligned with each other.

12. The method of claim 10 wherein a jig for securing the magnet block in place is disposed such that a side surface of the jig is parallel to the cutting plane of the magnet block, the side surface is a reference plane, the jig together with the magnet block secured thereby is turned upside down and placed such that the reference planes may be aligned with each other before and after the upside-down turning whereby the magnet block is turned upside down and the cutoff grooves formed before and after the upside-down turning are vertically aligned with each other.

13. The method of claim 12 wherein the jig is designed to secure a plurality of magnet blocks, and the jig together with the plurality of magnet blocks secured thereby is turned upside down such that the cutoff grooves formed in the plurality of magnet blocks before and after the upside-down turning may be aligned with each other at the same time.

14. The method of claim 10 wherein the rare earth magnet block is a sintered rare earth magnet block.

15. The method of claim 10 wherein in both of said machining operations from the upper surface of the magnet block and from the upper surface of the upside-down magnet block, said magnet block is machined by using the multiple blade assembly comprising the cores having an outer diameter of 80 to 250 mm, and having an effective diameter of up to 200 mm.

16. The method of claim 10 wherein in both of the first and second machining operations, respectively one multiple blade assembly is used.

17. The method of claim 16 wherein in both of the first and second machining operations, the same multiple blade assembly is used.

18. The method of claim 10 wherein the multiple blade assembly used in restarting the second machining operation is the same multiple blade assembly used in starting the first machining operation.

19. The method of claim 10 wherein the outer periphery surface of the peripheral cutting part is formed to a shape of an outer periphery surface of a cylinder.

* * * * *